US008496456B2

(12) United States Patent
Ree

(10) Patent No.: US 8,496,456 B2
(45) Date of Patent: Jul. 30, 2013

(54) PROGRESSIVE CAVITY PUMP INCLUDING INNER AND OUTER ROTORS AND A WHEEL GEAR MAINTAINING AN INTERRELATED SPEED RATIO

(75) Inventor: Sigurd Ree, Loddefjord (NO)

(73) Assignee: AGR Subsea AS, Straume (NO)

( * ) Notice: Subject to any disclaimer, the term of this patent is extended or adjusted under 35 U.S.C. 154(b) by 273 days.

(21) Appl. No.: 13/059,427

(22) PCT Filed: Aug. 7, 2009

(86) PCT No.: PCT/NO2009/000276

§ 371 (c)(1),
(2), (4) Date: Feb. 17, 2011

(87) PCT Pub. No.: WO2010/021550

PCT Pub. Date: Feb. 25, 2010

(65) Prior Publication Data

US 2011/0150687 A1 Jun. 23, 2011

(30) Foreign Application Priority Data

Aug. 21, 2008 (NO) ..... 20083617

(51) Int. Cl.

| | |
|---|---|
| ***F01C 1/10*** | (2006.01) |
| ***F03C 2/00*** | (2006.01) |
| ***F03C 4/00*** | (2006.01) |
| ***F04C 2/00*** | (2006.01) |

(52) U.S. Cl.
USPC ..... 418/48; 418/171; 418/182; 418/196

(58) Field of Classification Search
USPC ..... 418/48, 102, 152, 166, 171, 182, 418/196; 166/369, 73; 175/107, 323
See application file for complete search history.

(56) References Cited

U.S. PATENT DOCUMENTS

| | | | |
|---|---|---|---|
| 1,892,217 | A | 12/1932 | Moineau |
| 2,483,370 | A | 9/1949 | Moineau |
| 2,553,548 | A | 5/1951 | Canazzi et al. |
| 3,499,389 | A | 3/1970 | Seeberger et al. |
| 3,999,901 | A | 12/1976 | Tschirky |
| 4,080,115 | A | 3/1978 | Sims et al. |
| 4,482,305 | A | 11/1984 | Nátkai et al. |
| 4,592,427 | A | 6/1986 | Morgan |
| 4,676,725 | A | 6/1987 | Eppink |

(Continued)

FOREIGN PATENT DOCUMENTS

| | | |
|---|---|---|
| DE | 3119568 (A1) | 2/1982 |
| DE | 3712270 (A1) | 10/1988 |

(Continued)

OTHER PUBLICATIONS

U.S. Appl. No. 13/059,425, filed Feb. 17, 2011, Ree.

*Primary Examiner* — Theresa Trieu
(74) *Attorney, Agent, or Firm* — Foley & Lardner LLP

(57) ABSTRACT

A progressive cavity pump includes at least one inner rotor with Z external threads and at least one outer rotor with Z+1 internal threads. The outer rotor has radial bearings at both ends, whereas the inner rotor has a radial bearing only on one side, preferably the inlet side. There is arranged, on the same side as the bearing of the inner rotor, a conventional gear, for example a wheel gear, for maintaining a stable ratio between the rotational speeds of the inner and outer rotors exactly equal to (Z+1)/Z.

22 Claims, 6 Drawing Sheets

U.S. PATENT DOCUMENTS

| | | | | |
|---|---|---|---|---|
| 5,017,087 | A | 5/1991 | Sneddon | |
| 5,407,337 | A | 4/1995 | Appleby | |
| 5,549,465 | A * | 8/1996 | Varadan | 418/48 |
| 5,553,742 | A * | 9/1996 | Maruyama et al. | 418/48 |
| 5,722,820 | A | 3/1998 | Wiki et al. | |
| 6,063,001 | A | 5/2000 | Suhling et al. | |
| 6,241,494 | B1 | 6/2001 | Pafitis et al. | |
| 6,338,388 | B1 * | 1/2002 | Winkler | 418/48 |
| 6,439,866 | B1 * | 8/2002 | Farkas et al. | 418/48 |
| 7,074,018 | B2 * | 7/2006 | Chang | 418/48 |
| 7,413,416 | B2 | 8/2008 | Bartu | |
| 2001/0005486 | A1 | 6/2001 | Wood | |
| 2003/0019682 | A1 | 1/2003 | Schaedler et al. | |
| 2004/0057846 | A1 | 3/2004 | Denk et al. | |
| 2005/0169779 | A1 | 8/2005 | Bratu | |
| 2010/0239446 | A1 | 9/2010 | Ree | |
| 2010/0329913 | A1 | 12/2010 | Ree | |

FOREIGN PATENT DOCUMENTS

| | | | |
|---|---|---|---|
| DE | 86 17 489 | U1 | 11/1990 |
| DE | 197 15 278 | A1 | 12/1998 |
| EP | 0255336 (A2) | | 2/1988 |
| EP | 1400693 (A3) | | 3/2004 |
| EP | 1 418 336 | B1 | 5/2004 |
| EP | 1 559 913 | A1 | 8/2005 |
| NO | 327505 (B1) | | 7/2009 |
| WO | WO 99/22141 (A2) | | 5/1999 |
| WO | WO 2009/035337 | A1 | 3/2009 |

* cited by examiner

PROGRESSIVE CAVITY PUMP INCLUDING INNER AND OUTER ROTORS AND A WHEEL GEAR MAINTAINING AN INTERRELATED SPEED RATIO

This invention relates to a progressive cavity pump with inner and outer rotors intended for relatively high rotational speeds and great lifting heights with small vibrations.

BACKGROUND

Progressive cavity pumps, also called Mono pumps, PCP pumps, or Moineau pumps, are a type of displacement pumps which are commercially available in a number of designs for different applications. In particular, these pumps are popular for pumping high-viscosity media. Typically, such pumps include a usually metallic helical rotor which is termed, in what follows, the inner rotor, with Z number of parallel threads which are called thread starts in what follows, Z being any positive integer. The rotor typically runs within a cylinder-shaped stator with a core of an elastic material, a cavity extending axially through it being formed with (Z+1) internal thread starts. The pitch ratio between the stator and rotor should then be (Z+1)/Z, the pitch being defined as the length between adjacent thread crests from the same thread start.

When the geometric design of the threads of the rotor and stator is in accordance with mathematical principles written down by the mathematician Rene Joseph Louis Moineau in, for example, U.S. Pat. No. 1,892,217, the rotor and stator together will form a number of fundamentally discrete cavities by there being, in any section perpendicular to the centre axis of the rotor screw, at least one point of full or approximately full contact between the inner rotor and the stator. The central axis of the rotor will be forced by the stator to have an eccentric position relative to the central axis of the stator. For the rotor to rotate about its own axis within the stator, also the eccentric position of the axis of the rotor will have to rotate about the centre axis of the stator at the same time but in the opposite direction and at a constant centre distance. Therefore, in pumps of this kind there is normally arranged an intermediate shaft with 2 universal joints between the rotor of the pump and the motor driving the pump.

The pumping effect is achieved by said rotational movements bringing the fundamentally discrete cavities between the inner surfaces of the stator and the outer surfaces of the rotor to move from the inlet side of the pump towards the outlet side of the pump during the conveyance of liquid, gas, granulates etc. Characteristically enough, internationally these pumps have therefore often been termed "PCPs" which stands for, in the English language, "Progressive Cavity Pumps". This is established terminology also in the Norwegian oil industry, for example.

The volumetric efficiency of the pump is determined mainly by the extent to which these fundamentally discrete cavities have been formed in such a way that they actually seal against each other by the relevant rotational speed, pumping medium and differential pressure, or whether there is a certain back-flow because the inner walls of the stator yield elastically or because the stator and rotor are fabricated with a certain clearance between them. To increase the volumetric efficiency, progressive cavity pumps with elastic stators are often constructed with under-dimensioning in the cavity, so that there will be an elastic squeeze fit.

Not very well known and hardly used industrially to any wide extent—yet described already in said U.S. Pat. No. 1,892,217 —are designs of progressive cavity pumps in which a part, like the one termed stator above, is brought to rotate about its own axis in the same direction as the internal rotor. In this case the part with (Z+1) internal thread starts may more correctly be termed an outer rotor. By a fixed speed ratio between the outer rotor and the inner rotor, both the inner rotor and the outer rotor may be mounted in fixed rotary bearings, provided the rotary bearings for the inner rotor have the correct shaft distance or eccentricity measured relative to the central axis of the bearings of the outer rotor.

A limitation to the gaining of ground of such early-described solutions has probably been that an outer rotor needs to be equipped with dynamic seals and rotary bearings, which is avoided completely when a stator is used. On the other hand, an intermediate shaft and universal joints may, in principle, be avoided when the stator is replaced with an outer rotor.

In U.S. Pat. No. 5,407,337 is disclosed a Moineau pump (here called a "helical gear fluid machine"), in which an outer rotor is fixedly supported in a pump casing, an external motor has a fixed axis extending through the external wall of the pump casing parallel with the axis of the outer rotor in a fixed eccentric position relative to it, and the shaft of the motor drives, through a flexible coupling, the inner rotor which has, beyond said coupling, no other support than the walls of the helical cavity of the outer rotor, the material is assumed to be an elastomer. In this case the rotation of the outer rotor is driven exclusively by movements and forces at the contact surfaces of the inner cavity against the inner rotor. A drawback of this solution is that if there is considerable clearance at or elastic deflection of the contact surface, the inner rotor or the outer rotor will be moved more or less away from its ideal relative position. Further, by increasing load, the driving contact surface between the inner and outer rotors will be moved constantly nearer to the motor and force the inner rotor more and more out of parallelism relative to the axis of the outer rotor, so that over the length of the outer rotor, the inner rotor will contact the outer rotor on diametrically opposite sides with consequent friction loss, wear on rotors and motor coupling and also possible signs of wedging. Vibrations, erratic running and reduced efficiency may also be expected.

In U.S. Pat. No. 5,017,087 as well as WO99/22141 inventor John Leisman Sneddon has shown designs of Moineau pumps, in which the outer rotor of the pump is enclosed by and fixedly connected to the rotor of an electromotor whose stator windings are fixedly connected to the pump casing. In these designs the outer and inner rotors of the pump are both fixedly supported radially at both ends in the same pump casing, so that the outer and inner rotors of the pump function together as a mechanical gear, driving the inner rotor at the correct speed relative to the outer rotor which, in turn, is driven by said electromotor. In this case as well, signs of wedging between the inner and outer rotors may arise, in particular if solid hard particles seek to wedge between the inner and outer rotors where these have their driving contact surfaces. Besides, a disadvantage of an inner rotor fixedly supported at both ends is that if the pumping medium is of a kind which must be separated from contact with the bearings, independent dynamic seals will be needed at both ends for both the inner rotor and the outer rotor, as these do not have a common rotary axis.

In U.S. Pat. No. 4,482,305 is shown a pump, flow gauge or similar according to the PCP principle with inner and outer rotors. Here is used a wheel gear outside the pump rotors which ensures a stably correct relative rotational speed between the inner and outer rotors, independently of internal contact surfaces between them. This ensures smoother running, in particular by great pressure differences and/or spacious clearances—which may be necessary to achieve a gradual pressure increase when compressible media are pumped. However, it is assumed here as well that there are dynamic seals and radial bearings at both ends of the inner rotor. The dynamic seal for the outer rotor is also complicated by the diameter of the sealing surface having to be large enough to allow an internal passage for both the pumping medium and the bearing shaft on the extension of the active helical part of the inner rotor.

The invention has for its object to remedy or reduce at least one of the drawbacks of the prior art.

The object is achieved through features which are specified in the description below and in the claims that follow.

SUMMARY

The present invention seeks to combine the best aspects of the U.S. Pat. Nos. 4,482,305 and 5,017,087 mentioned, by a wheel gear or similar on one side of the inner and outer pump rotors ensuring smooth and exactly correct relative rotational speed for both rotors independently of the contact surfaces between the inner and outer rotors, while at the same time a bearing, bearing shaft and associated dynamic seal are installed only at the end of the inner rotor at which forces are transmitted from said wheel gear or similar. It is assumed that the outer rotor is made with great flexural and torsional rigidity whereas the inner rotor preferably has great torsional rigidity but little flexural rigidity. These will also be natural properties for the inner rotor considering its other functions. It can be demonstrated that the resultant of the hydraulic forces affecting the inner rotor directly in a radial direction has an approximately constant angular position and, moreover, by constant operating conditions, a constant magnitude. Therefore, the inner rotor will tend always to lean towards the same side, where it will get support at all times from the cavity walls of the outer rotor at a number of contact surfaces corresponding to Z× the number of revolutions of the screw of the inner rotor. These contact surfaces will move linearly towards the outlet side of the pump and be renewed for every revolution. This gives very moderate vibrations. The length and flexural rigidity of the supporting shaft of the inner rotor and clearances between the inner and outer rotors can easily be adjusted in such a way that changing bending stresses caused during operation, by the inner rotor leaning against the supporting surfaces of the outer rotor, will be acceptable. The principal stresses on the inner rotor will be approximately constant torsional stresses.

Please note that in contrast to U.S. Pat. No. 5,407,337 all the contact surfaces against the outer rotor will be on the same side in a PCP pump according to the invention, so that at great pressure differences and/or clearances between the rotors, the active helical part of the shaft of the inner rotor will tend towards a minor parallel translation instead of an angular displacement, so that bearing forces will not occur on opposite sides of the inner rotor. An extended axis towards a bearing will have a deflection, whereas it can be demonstrated that twisting in consequence of torsion will usually be moderate. When an undesired hard particle positions itself between the contact surfaces of the inner and outer rotors in a PCP pump according to the invention, the driving torque applied to both the inner rotor and the outer rotor from the wheel gear will tend to push the particle away or let the particle roll between the contact surfaces. This different from the situation when, for example, the inner rotor is driven only by the contact surfaces against the outer rotor—as in U.S. Pat. No. 5,017,087 and WO99/22141—in which such a particle will reduce the torque arm of the driving force and may even turn its direction.

In a PCP construction according to the invention and with the wheel gear placed on the inlet side, there will only be a need for one dynamic seal on the outlet side, at which the pressure is the greatest. It seals against the outer rotor. In a preferred embodiment, the diameter of the contact surfaces of the seal can be minimized by the inner rotor being terminated upstream relative to the seal so that its area will not make a deduction from the effective flow area of the outer rotor, by the necessary effective flow area being gradually changed into a circular shape up to the position of the seal, and by the diameter of the seal exceeding the diameter of the flow area to the least extent possible. A mechanical seal in which both a spring-loaded part and one abutment seat are arranged for tight internal mounting in bores will be a preferred embodiment here.

A progressive cavity pump comprising at least one inner rotor with Z external threads and at least one adapted outer rotor with Z+1 internal threads is thus characterized by the outer rotor having at least two radial bearings—preferably one close to either end—whereas the inner rotor has a radial bearing only to one side of its helical part, and by there being arranged, on the same side as the bearing of the inner rotor, a conventional gear, for example a wheel gear, which is arranged to maintain a stable ratio between the rotational speeds of the inner and outer rotors, equalling the ratio (Z+1)/Z independently of driving contact between the helical surfaces of the inner and outer rotors.

The progressive cavity pump may be formed in such a way that the conventional gear and the bearing of the inner rotor are arranged on the inlet side of the pump.

The progressive cavity pump may be formed in such a way that the diameter of the dynamic seal of the outer rotor on the outlet side is minimized by the inner rotor being terminated upstream relative to the seal, that a flow area in the outer rotor is circular under a seal and that the cavity cross section of the outer rotor is reduced in this area, in principle according to the cross-sectional area of the helical part of the inner rotor.

The progressive cavity pump may be formed in such a way that as a seal on the outlet side of the outer rotor is used a mechanical seal of such design that both static and dynamic parts are adapted for installation internally in bores.

In particular for installation in narrow pipes and where low reservoir pressure on the suction side gives a risk of cavitation, the progressive cavity pump may be formed in such a way that the conventional gear and the bearing of the inner rotor are arranged on the outlet side of the pump, that the inner rotor starts downstream relative to the bearings and dynamic seals of the outer rotor on the inlet side, and that the flow area upstream relative to the helical parts of the inner and outer rotors is circular with a maximal area relative to the space available within the bearings and seals of the outer rotor.

The progressive cavity pump may be formed in such a way that a wheel gear is used, in which an external toothing on the inner rotor is engaged with an internal toothing on an intermediate wheel having its rotary axis parallel with the inner rotor and eccentrically on the opposite side relative to the axis of the outer rotor, the intermediate wheel also having an external toothing, and the external toothing of the intermediate wheel being engaged with an internal toothing on the outer rotor.

The progressive cavity pump may be formed in such a way that the motor is arranged eccentrically relative to the outer rotor for and drives the inner rotor directly via a conventional coupling.

The progressive cavity pump may be formed in such a way that the motor is arranged concentrically and drives the inner rotor via an intermediate shaft with two universal joints.

The progressive cavity pump may be formed in such a way that the outer rotor is driven directly by a motor by the rotor of the motor being fixedly connected to and concentrically surrounding the outer rotor of the pump, and the stator of the motor being fixed in the same housing as the bearings of the outer rotor of the pump, said housing consisting of one part or possibly several parts rigidly connected to each other.

The progressive cavity pump may be formed in such a way that the motor is installed concentrically with the axis of the outer rotor, and that on the drive shaft of the motor is mounted a gearwheel engaged with a gearwheel on the inner rotor of the pump.

The progressive cavity pump may be formed in such a way that the rotor of the motor constitutes a direct extension of the outer pump rotor on the opposite side of the conventional gear, that the rotor of the motor only or partially has the same bearings and dynamic seals as the outer pump rotor, and that the rotor of the motor has an internal, preferably circular cavity in the direct extension of the helical cavity of the outer pump rotor.

The progressive cavity pump may be formed in such a way that the fixed connection between the outer pump rotor and the rotor of the motor contains substantially radial openings which allow parts of the pumping medium to flow externally past the motor to contribute to the cooling thereof.

The progressive cavity pump may be formed in such a way that dynamic seals are arranged on both sides of said openings to prevent the pumping medium from direct contact with motor windings or bearings.

The progressive cavity pump may be formed in such a way that the rotor of the motor is hollow, allowing flow-through of pumping medium.

The progressive cavity pump may be formed in such a way that there is used a wheel gear comprising for the outer rotor a driving gearwheel with external toothing surrounding the cavity of the outer rotor, for the inner rotor a driving gearwheel with external toothing surrounding a flow area, and for the pump motor a driving gearwheel arranged concentrically relative to the outer rotor, that there are at least two planet shafts with rotary axes arranged at the same fixed distance from the rotary axes of the motor and outer rotor, that each of the planet shafts contains a respective gearwheel for constant engagement with the gearwheels of the outer rotor and the motor, respectively, and that one or two of said planet shafts additionally contain(s) a gearwheel for constant engagement with the gearwheel of the inner rotor.

The progressive cavity pump may be formed in such a way that the motor surrounds the outer rotor in such a manner that the outer rotor and the rotor of the motor are combined and rotate together in common bearings, that on one side—preferably the inlet side—the outer rotor has an external toothing which is constantly engaged with one or two planet wheels, each with two wheels on a common shaft, one of which is engaged with the gearwheel of the outer rotor and the other is engaged with a gearwheel fixedly and concentrically mounted on the inner rotor, and that the gearwheels together form the gear ratio (Z+1)/Z between, respectively, the inner rotor and the outer rotor of the pump.

BRIEF DESCRIPTION OF THE DRAWINGS

In what follows in described an example of a preferred embodiment which is visualized in the accompanying drawings, in which.

DETAILED DESCRIPTION

Figure 1:
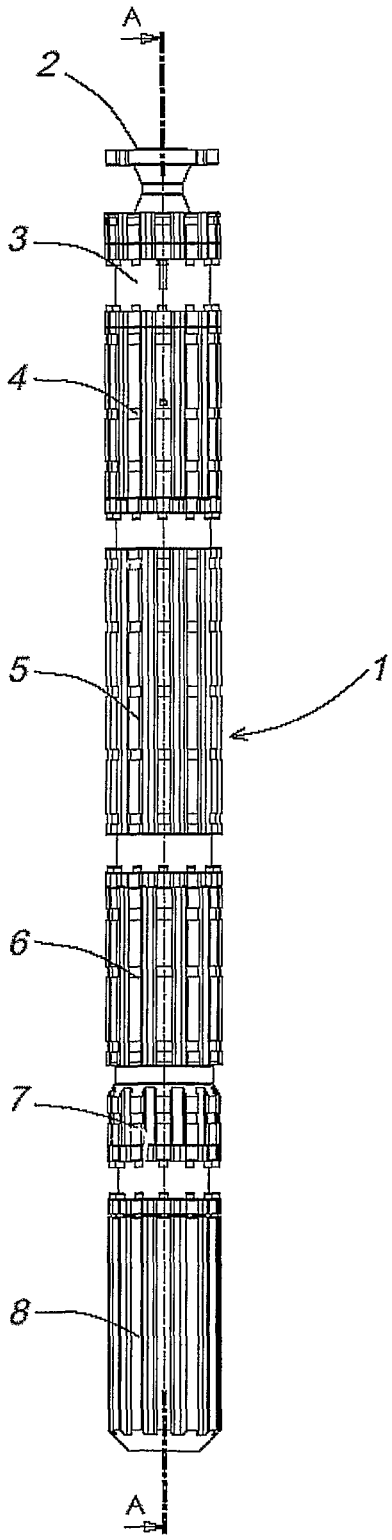
FIG. 1 shows the exterior of a pump in accordance with the invention made as a downhole pump for crude oil.

In the drawings, the reference numeral 1 indicates in FIG. 1 a downhole pump, the reference numerals 2-8 indicating the different sections of the pump 1 which have different principal functions:

Section 2 comprises an adapter flange for tight connection between the pump and a riser for crude oil from a production well.

Section 3 balances the pressure of a supplied lubricating and cooling agent against the outlet pressure.

Section 4 contains a pressure-balanced dynamic—preferably mechanical—seal for an outer rotor, so that crude oil or contaminants in the crude oil does/do not enter the pump casing and mix with the lubricating and cooling agent. In addition, the section 4 preferably accommodates a pressure relief device for the lubricating and cooling agent, so that the lubricating pressure will be lower on the inlet side than on the outlet side and, therefore, to a lesser extent will leak into the pumping medium on the inlet side.

Section 5 contains the active, helical parts of the inner and outer rotors of the pump. Here the pumping medium is enclosed in several separate cavities between the inner and outer rotors. These cavities move linearly and continuously from the inlet side towards the outlet side while carrying the crude oil when the pump is typically activated in an oil well with insufficient well pressure.

Section 6 contains a wheel gear in accordance with an embodiment of the invention, and also a bearing for an extension of the inner rotor, rigidly connected in terms of rotation to the helical part thereof.

Section 7 forms a transition piece with a driving gearwheel coupling for the mounting of the pump motor, Section 8.

The liquid intake of the pump occurs in this case between the pump sections 6 and 7, so that on its way to the suction intake the crude oil flows externally past the motor 8, contributing to the cooling thereof.

It should be noted that even though in this exemplary embodiment the pump is assembled from sections screwed together is axially, completely different embodiments will also be possible. For example, an embodiment is conceivable in which the entire pump casing is split into 2 longitudinal parts, each part extending over the full length from the motor to the outlet flange, but in which the dividing line between the parts substantially follows a plane through the central axes of the inner and outer rotors.

Figure 2:
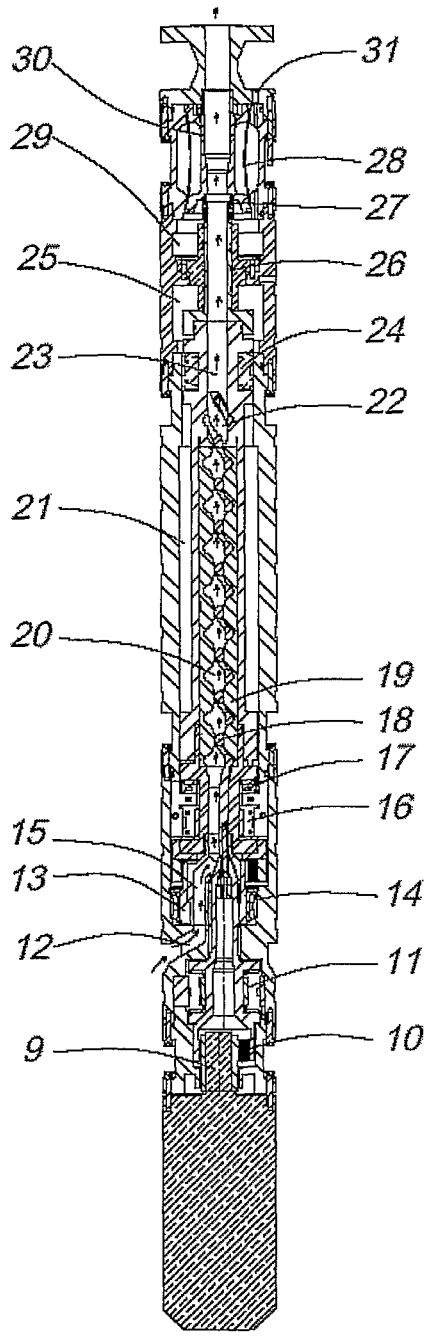
FIG. 2 shows a longitudinal section along the line A-A of the entire pump in accordance with the embodiment of FIG. 1.
Figure 2A:
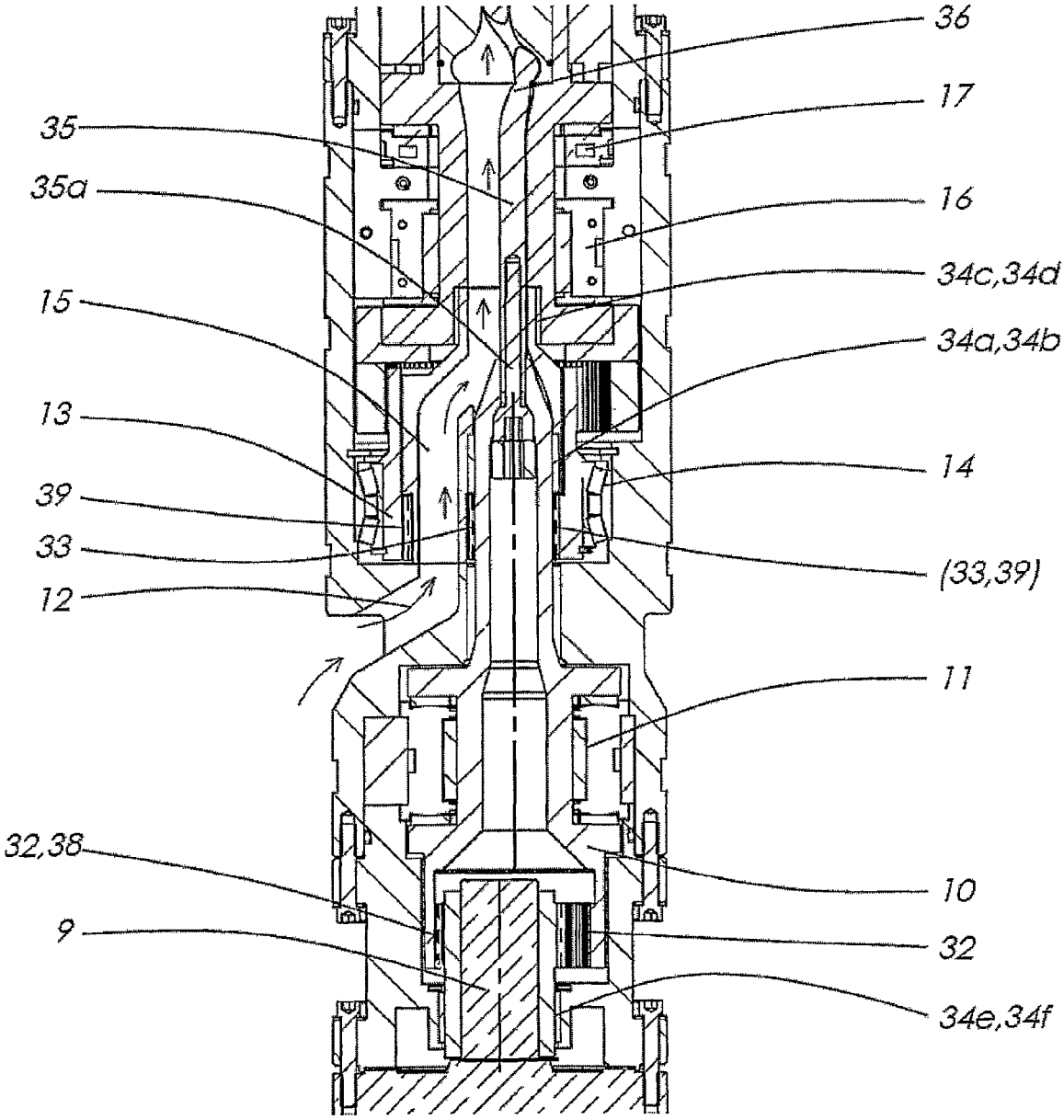
FIG. 2A, FIG. 2B and FIG. 2C show, enlarged and with more detail references, different parts of the same cross section as FIG. 2.
Figure 2B:
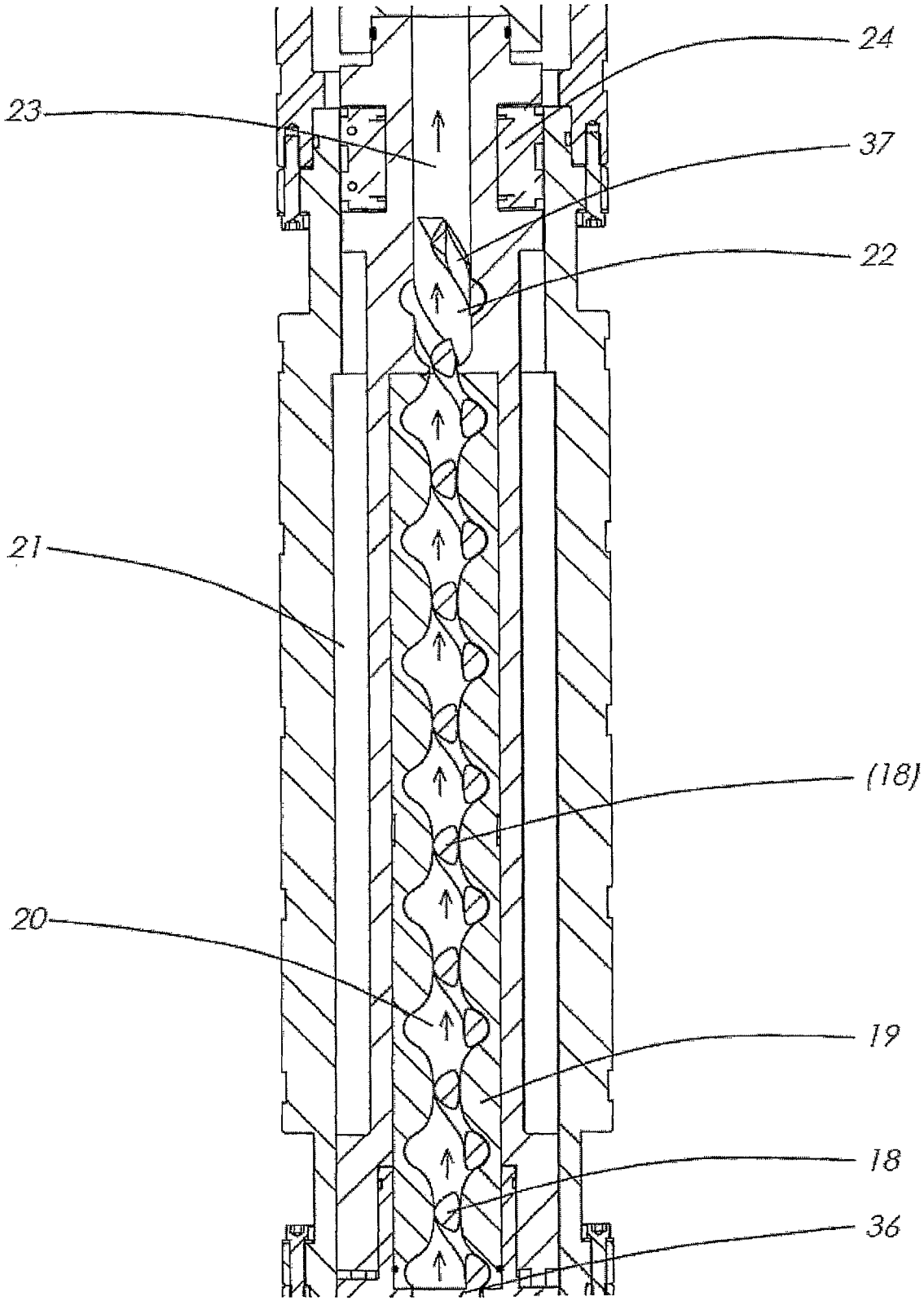
Figure 2C:
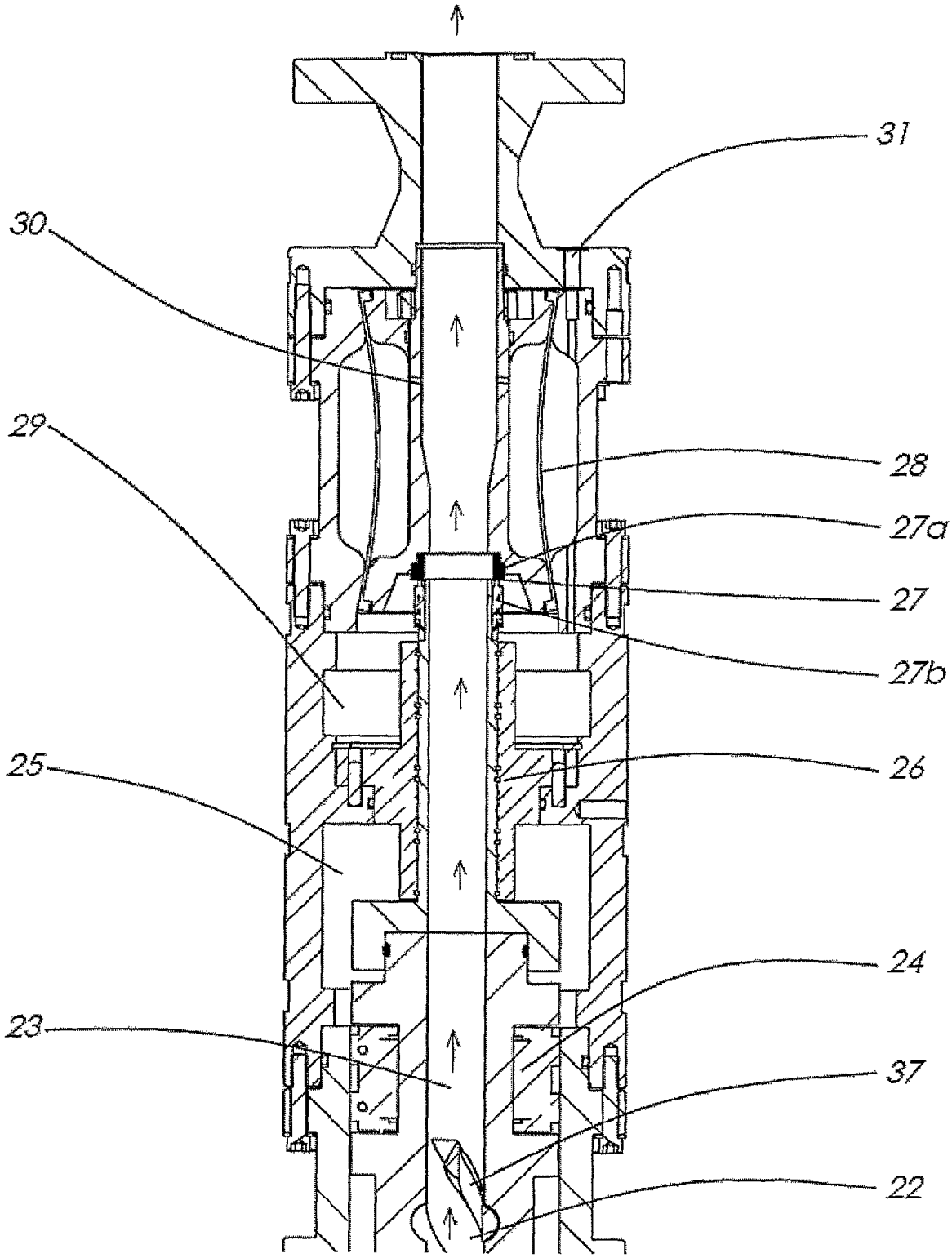

From the section in FIG. 2 is seen, on a small scale, how some important components of the pump of FIG. 1 are arranged relative to each other with said sections. Several of these components are shown more clearly in other figures on a larger scale, see therefore also FIGS. 3 and 4, in which reference numerals which have also been used in the same sense in previous figures are shown in brackets. It should be noted that no details of the motor 8 are shown, as this per se is assumed not to contain novel, patentable features. However, it is of importance to this slim construction, meant for downhole installation, that the shaft 9 of the motor extends concentrically relative to the pump casing and the outer rotor 19 of the pump. This is made possible by there being mounted on the centric motor shaft 9 an external gearwheel 38, see FIG. 4, which is in constant engagement with an internal gearwheel 32, see FIG. 3 or FIG. 4, on the extension 10 of the helical part 18 of the eccentrically mounted inner rotor. A bearing 11 for the extension of the inner rotor—in this case a hydrodynamic radial bearing capable of absorbing also radial forces—is arranged with strictly adjusted eccentricity relative to the radial bearings 16 and 24 of the outer rotor 19. or the outer rotor there is also arranged a thrust bearing 17, whereas the inner rotor 18 and its fixed extension 10 on their part do not have is any supports other than 11, the outer rotor 19 and in particular its outlet section 22 functioning as sufficient support for the outer rotor on the outlet side.

Figure 4:
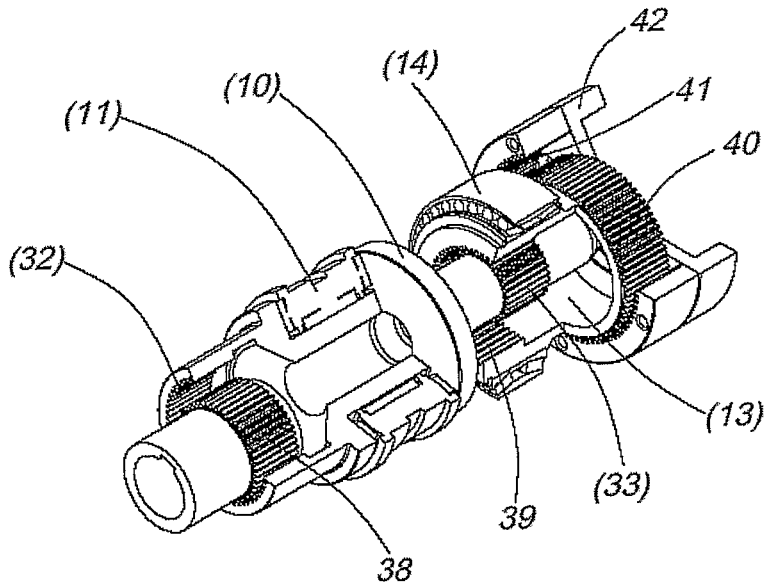
FIG. 4 shows in a simplified manner a gear installed on the inlet side of the pump according to FIG. 1, FIG. 2 and FIG. 3.
Figure 5:
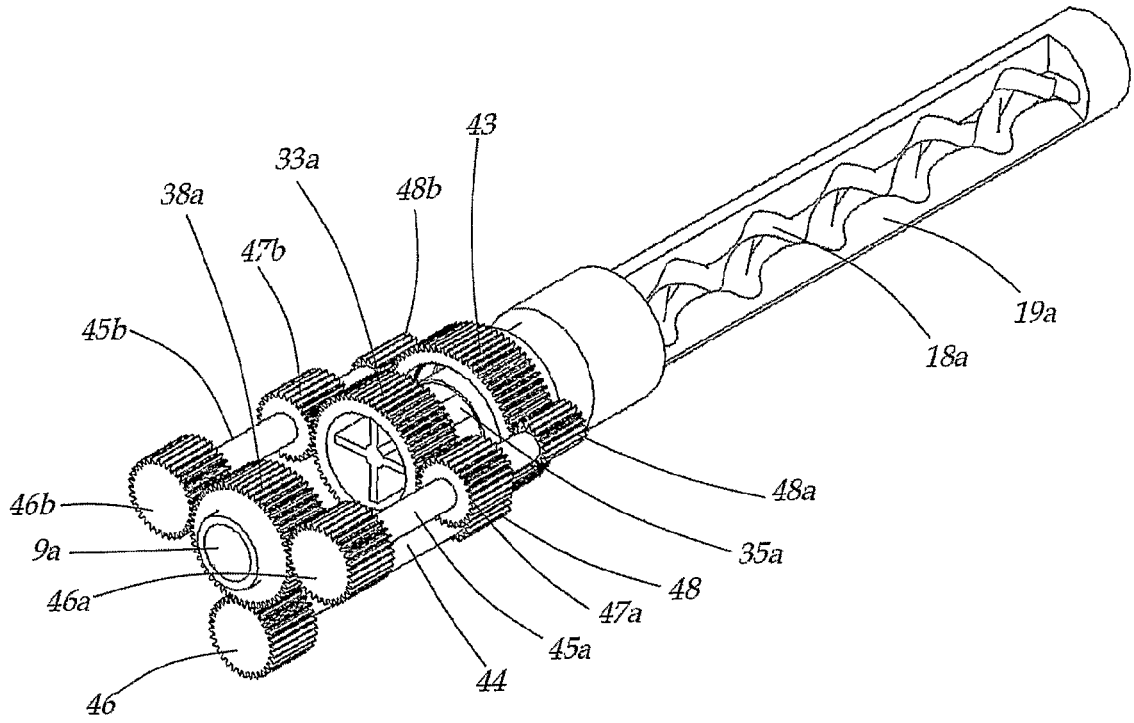
FIG. 5 shows an alternative embodiment of a gear for mounting on either the inlet side or the outlet side of a pump according to the invention.

To reduce the risk of wedging or substantial vibrations between the inner and outer rotors, it is assumed according to the invention that a wheel gear or similar is arranged, see FIG. 4 and FIG. 5, on the same side as the bearing 11, and that this gear enforces the exact gear ratio of Z/(Z+1) between the outer and inner rotors. In the embodiment in FIG. 2 and in FIG. 4 this wheel gear includes a cylindrical intermediate gear 13 which is supported 14 eccentrically, in a torsionally rigid manner, relative to the bearings 16 and 24 of the outer rotor but on the opposite side relative to the eccentricity of the bearing 11 of the inner rotor. The intermediate wheel 13 has an internal toothing 39 engaged with an external toothing 33 on the extension of the inner rotor, and an external toothing 40 engaged with an internal toothing 41 on the inlet side of the outer rotor. In this exemplary embodiment, the pumping medium, for example crude oil, is sucked into the fixed opening 12 on the side of the pump casing and further through the fixed channel 15 and under a wearing ring into the initial cylindrical cavity of the outer rotor under the bearings 16 and 17 thereof. Further, the liquid is sucked into the first of the fundamentally separate pump cavities 20, following its linear movement, imparted by the rotations of the outer and inner rotors, up to the principally cylindrical outlet cavity 22, 23 of the outer rotor. The cavity of the outer rotor is further extended by the rotating part in a labyrinth seal 26 for pressure relief of the surrounding cooling and lubricating agent running upstream. From here, the crude oil continues past a concentric and pressure-balanced mechanical seal 27 with a static seat 27*a* and a dynamic part 27*b*, forming the only dynamic seal for the pumping medium on the outlet side. Further, there is rectilinear flow through a static cavity 30 into the riser assumed to be connected to the outlet flange 2.

A lubricating and cooling agent—preferably also used as the fluid in hydrodynamic bearings—is supplied in small dosed amounts, intermittently or continuously, through a small pipe connection in an intake opening 31, filling the cavity surrounding a flexible pressure-equalizing diaphragm 28. The space on the inside of the pressure-balancing diaphragm has an open connection to a static outlet cavity 30, but is otherwise completely tight. Even by rather approximate dosing of the lubricating and cooling agent—for example controlled by signals from a pressure sensor—the pressure difference across the mechanical seal 27 will stay close to zero at all times, so that the leakage will be very small and the mechanical bearing pressure on the sealing surface may be limited in favour of low friction.

In order to flow on upstream within a cavity 25 to a bearing 24 etc., the lubricant filling a cavity 29 outside the seal 27 at a pressure corresponding to the outlet pressure must pass narrow fits in the labyrinth seal 26 which may be assembled from several sections of a conventional type or, for example, be made with helical grooves between annular grooves, so that during rotation the helical grooves will bring about increased counterpressure.

The function of the labyrinth seal is not primarily to retain contaminants but to bring about a substantially lower pressure in the cooling and lubricating agent on the inlet side than on the outlet side. The dynamic seals, for example in the form of conventional wearing rings which will possibly be needed to separate the pumping medium from the lubricating and cooling liquid at both wear rings 34*a*, 34*b* and an outer rotor 34*c*, 34*d* on the inlet side, may therefore have a moderate external overpressure controlled by the flow rate applied through an intake 31 and the labyrinth seal 26. This flow rate may either be identical to an accepted leakage flow through the wearing rings—which let some lubricating and cooling agent get mixed into the crude oil and be recovered together with it—or be greater, by the excess parts being conveyed in separate return lines, not shown, back to a lubricating and cooling agent feed pump. In the example there are further wearing rings 34*e*, 34*f* which prevent leakage of lubricating and cooling liquid along the motor shaft 9. In the cavity 20 between the outer rotor and the external walls of the pump casing there may be advantageously arranged a cooling circulation of cooling and lubricating agent, for example by the outer rotor being made with helical external grooves, wings, or similar, not shown.

Figure 3:
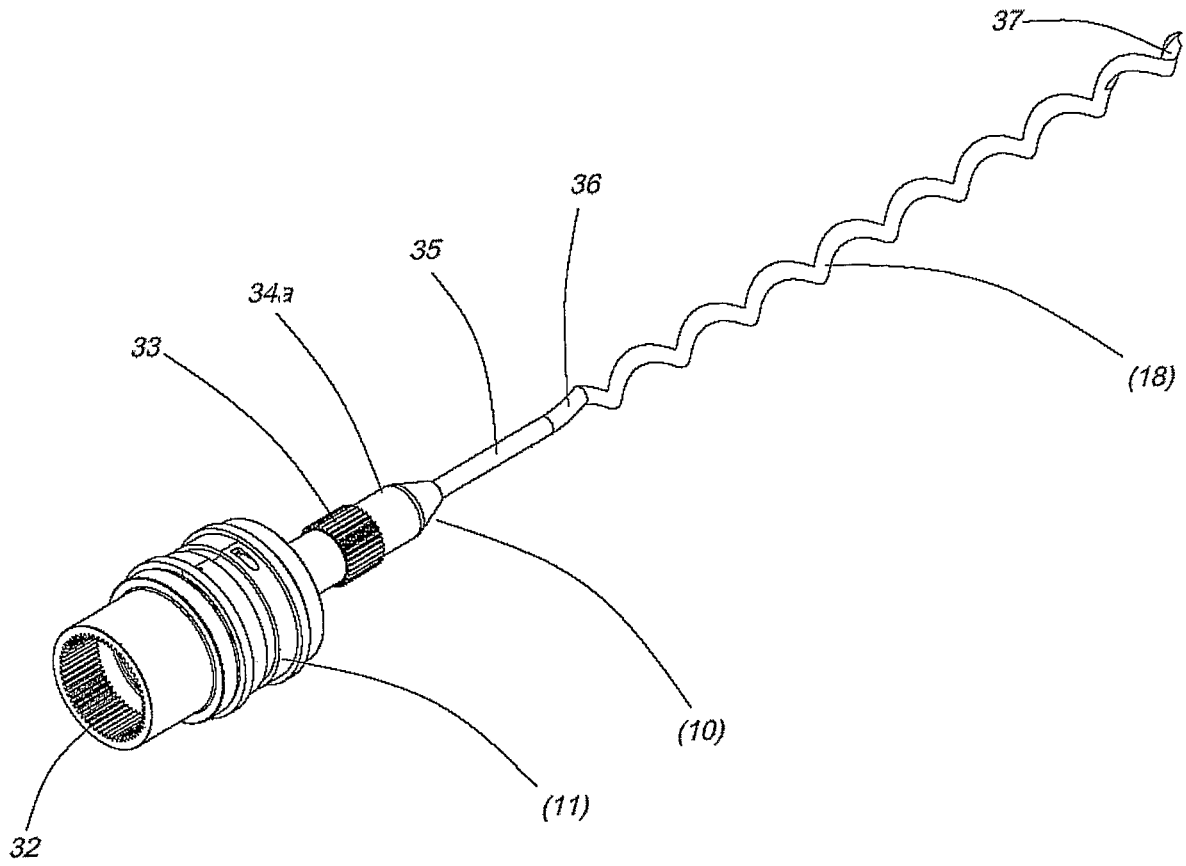
FIG. 3 shows the inner rotor of the exemplary embodiment of FIG. 1, complete with a helical part and extension with bearing and gearwheels.

From FIG. 3 it appears how the helical part 18 of the inner rotor is terminated in this example by a stepped-down cross section 37 on the outlet side, though in such a way that this cross section retains the helical external geometry allowing support from the corresponding cavity geometry near the outlet side 22 of the outer rotor. Towards the inlet side, the helical part 18 of the inner rotor merges via a bend 36 into a torsionally rigid, but less flexurally rigid, straight drive shaft 35 with a central axis extending at least approximately through the centre of gravity of the helical part. The drive shaft 35 is, in turn, rigidly but detachably connected to a more rigid cylindrical part 10 which rotates in the bearing 11 of the inner rotor. A bend 36 is deflected, in this case, only in one plane to compensate for the eccentric position of the transversal section of the helical part. The modest flexural rigidity of the drive shaft 35 allows the helical part 18 to roll over, or otherwise make room for, hard particles which occasionally position themselves in the narrowest gap between the inner and outer rotors, without this causing dramatic load peaks on the bearing 11 of the inner rotor.

The transition between the drive shaft 35 and the extension 10 of the inner rotor with the bearing 11 and the gearwheel 33 is formed, for reasons of installation, by a releasable connection, for example in the form of splines 35*a* and a central bolt which is screwed from a hollow within the toothing 32 into the drive shaft 35. The wear ring 34*a* is mounted on a flexurally rigid cylinder surface and has a wear coating with a precision fit adapted to a wearing ring 34*b* assumed to be mounted in section 6 of the pump casing. Together the wearing surface 34*a* and the wearing ring 34*b* form sufficient sealing between the space filled with lubricating oil surrounding the gearwheel 33 and the pumping medium, for example crude oil with a certain content of sand particles, surrounding the sections 35, 36, 18 and 37 during operation. On account of precision in the wearing ring and tooth engagement, the hydrostatic bearing 11 shown may possibly be replaced with a particularly torsionally rigid and positionally accurate roller bearing or bearings mounted in pairs.

In a gear embodiment which is shown with parts partially cut through in FIG. 4, there is used, as a bearing 14 for the intermediate wheel 13, a double-row angular-contact roller bearing because this provides a torsionally rigid support with sufficient precision and capacity for the torque trans-mission in the gearwheels. An intermediate 42 forms a rigid connection between a gearwheel 41 and the other parts 19 etc., which are not shown in FIG. 4, together forming the outer rotor of the pump. Having an inner rotor like 18, which has Z=1 thread starts, necessitates a gear ratio of Z/(Z+1)=1/2 between the gearwheel 41 of the outer rotor and the gearwheel 33 of the inner rotor and that the inner and outer rotors have the same direction of rotation. There is no tolerance in this gear ratio.

In the exemplary embodiment shown this is achieved by the gearwheel 33 having $z_1$=33 teeth, the gearwheel 39 having $z_2$=57 teeth, the gearwheel 40 having $z_3$=76 teeth and the gearwheel 41 having $z_4$=88 teeth. The gear ratio then meets the requirement by:

$$(z_3/z_4)*(z_1/z_2)=(76*33)/(88*57)=½=Z/(Z+1)$$

To make it possible to mount the motor shaft 9 and gearwheel 38 concentrically relative to the outer rotor 41, 42, 19 etc.—without the use of an intermediate shaft with cardan joints, which is usual in classic PCP pumps—the difference between the tooth number $z_5$ of the gearwheel 32 on the extension of the inner rotor and the tooth number $z_6$ of the gearwheel 38 on the motor shaft must be:

$$(z_5-z_6)\sim\pm(2*E)/m_1$$

in which E is the eccentricity or distance between the central axes of the inner rotor and the outer rotor, or motor, $m_1$ is the gearwheel module of this pair of teeth, and a certain degree of approximation is allowed by involute toothing, for example. This requirement does not normally constitute a critical limitation as the motor may have rotational speed control (VFD), as the gear ratio between the motor and pump rotors can be varied by varying the tooth numbers $z_5$ and $z_6$ in parallel, and as the gear ratio may be made greater or smaller than 1 by switching any of the gearwheels 38 and 32 which are given internal toothing and external toothing, respectively.

However, what is more limiting to selectable combinations of module and tooth number is the following requirement:

$$(z_4-z_3)\sim(2*E_m)/m_2$$

in which $E_m$ is the shaft distance between the outer rotor—coinciding with the gearwheel 41—and the intermediate wheel 13, and $m_2$ is the module of this pair of teeth, which may be different from the module of the pair of teeth 32, 38. It is assumed here that the centre axis of the intermediate wheel is in the same plane as the axes of the outer and inner rotors, but that the intermediate wheel is on the opposite side relative to the inner rotor.

It is further required that:

$$(z_2-z_1)\sim(2*(E+E_m))/m_3$$

in which $m_3$ may be a further module for this pair of teeth. The selectability of $m_1$, $m_2$, $m_3$ and $E_m$ will in most cases make it possible to adapt a suitable gear according to the principles of the exemplary embodiment shown. In the figure examples used, the requirements are met with equal gearwheel modules and opposite equal eccentricities:

$$m_1=m_2=m_3 \text{ and } E_m=E.$$

In FIG. 5 is shown a fundamentally differently constructed wheel gear. Here, an outer rotor 19*a*, which is shown simplified and partly cut through, is rigidly connected to the external gearwheel 43, whereas the inner rotor 18*a* is rigidly connected to the external gearwheel 33*a*. The bearings of the inner and outer rotors are not shown. Three gearwheel shafts 44, 45*a*, 45*b* are arranged parallel to and equidistantly from the rotary axis of the outer rotor 19*a* and its gearwheel 43. On the gearwheel shaft 44 are mounted 2 concentric, external toothings 46 and 48, 48 thereof engaging the toothing 43 of the outer rotor whereas 46 engages a driving gearwheel 38*a* mounted on the motor shaft 9*a*, a motor (not shown) having its rotary axis coinciding with that of the outer rotor. In principle, the gearwheel shafts 45*a*, 45*b* differ from 44 only by having a further external toothing 47*a*, 47*b*. The gearwheels 48*a*, 48*b*, 48 have mutually equal tooth numbers and share the engagement with 43, the gearwheels 46*a*, 46*b*, 46 also have mutually equal tooth numbers and share the engagement with 38*a*, whereas the gearwheels 47*a*, 47*b* are alike and share the engagement with the gearwheel 33*a* of the inner rotor. By the fact that only two gearwheels 47*a*, 47*b* are engaged with the gearwheel 33*a* of the inner rotor whereas three gearwheels 48, 48*a*, 48*b* are engaged with the gearwheel 43 of the outer rotor 43, the inner rotor is allowed to have its rotary axis parallel with, but eccentrically spaced (E) from, the rotary axis of the outer rotor. It may be advantageous, like in the example shown, that the axes of the inner rotor and of the gearwheels 47*a*, 47*b* are approximately in the same plane. Further, it may be advantageous on account of load conditions and for constructive reasons that the gearwheel shafts 44, 45*a* and 45*b* are approximately equally spaced apart, but this is not a necessary requirement. The shaft 44 with the gearwheels 46 and 48 may even be omitted completely or be replaced with several like shafts mounted equidistantly from the rotary axis of the outer rotor. Similarly, one of the shafts 45*a*, 45*b* may be omitted if this allows sufficient power transmission. On the other hand, there may not be more than two shafts like 45*a*, 45*b* with gearwheels 47*a*, 47*b* engaging the gearwheel 33*a* of the inner rotor, and when two shafts 47*a*, 47*b* are used, the plane through their rotary axes must stand perpendicularly to the plane through the rotary axes of the inner rotor 33*a*, 18*a* and the outer rotor 43, 19*a*. Further, the following gear ratio must be met:

$$(z_o/z_{P1})*(z_{P2}/z_1)=(Z+1)/Z$$

in which Z is the number of thread starts of the inner rotor Z=1 of FIG. 5, $z_o$ is the tooth number of the gearwheel 43 of the outer rotor, $z_{P1}$ is the tooth number of the "planet wheels" 48, 48*a*, 48*b*, $z_{P2}$ is the tooth number of the planet wheels 47*a*, 47*b* and $z_1$ is the tooth number of the gearwheel 33*a* of the inner rotor.

Figure 6:
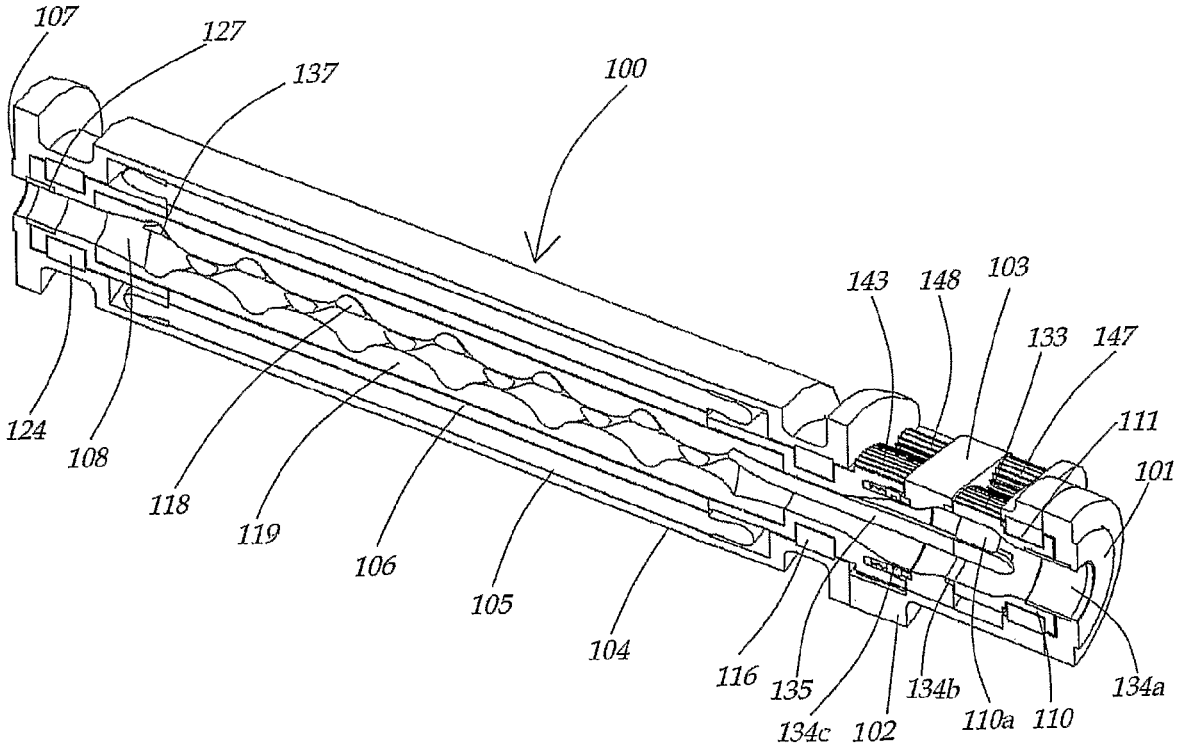
FIG. 6 shows an embodiment of the pump according to the invention, in which a motor surrounds the pump and the rotor of the motor is combined with the outer rotor of the pump.

In FIG. 6, cut through and simplified, is shown a further embodiment 100 of a pump and motor assembly in accordance with the invention. This is an embodiment which will be more compact in the axial direction and which will simplify the construction of the conventional gear, but which will also demand more space transversally to the direction of flow of the pumping medium. This embodiment is conceived to be installed in such a way that it replaces an approximately straight pipe piece between two concentric pipe flanges, the pipe flanges with intermediate gaskets being bolted, bolting holes (not shown) being against, respectively, a surface 101—which may be the inlet side or the outlet side of the pump, depending on the direction of rotation—and the surface 107 on the opposite side of the pump. The pump with a motor and gear is sealedly encased in the gear housing 102, shown to have been cut through in two planes, and the pump casing 101 which are sealedly connected to each other and to said pipe flanges. The rotor 106 of the motor surrounds and is fixedly combined with the outer rotor 119 of the pump, so that in this case the rotor of the motor and the outer rotor of the pump share the bearings 116 and 124. The stator 105 of the motor is rigidly connected to the pump casing 104. The inner rotor 118 of the pump with the rotationally rigid but less flexurally rigid drive shaft 135 is rigidly connected to a hollow extension 110 via spokes 110*a* which are preferably helical, but shown in a simplified manner. Preferably, the hollow extension 110 of the inner rotor, which also includes an external toothing 133, is fixed axially but rotates freely in a bearing 111 forming the only bearing of the inner rotor. On the opposite side, the helical part 118 of the inner rotor is preferably terminated by a stepped-down end 137 near the termination of the helical cavity of the outer rotor 119. Near the mounting flange 107, there is only 1 dynamic seal 127, for example in the form of a wearing ring. If it is not necessary to isolate the motor, bearings and gearwheel connections from the pumping medium, it is possible, if the pump rotates in such a way that the flange 107 comes on the outlet side, to omit dynamic seals on the opposite side, so that the seal 127 will be the only dynamic seal of the pump. However, in FIG. 6, it is assumed that the pumping medium is of such a kind that this cannot be allowed. In principle, it may then become necessary to have another 3 dynamic seals 134*a*, 134*b*, 134*c*, 134*a-b* sealing against the inner rotor, whereas 134*c* seals against the outer rotor. In the figure is suggested a particular embodiment variant, in which 134*c* is a spring-loaded mechanical seal in which the springs also provide bearing pressure between the sealing surfaces 134*b* by the intermediate 103 being formed as a slide which glides freely in an axial direction within the gear housing 102.

The conventional gear which is to maintain, according to an embodiment of the present invention, the correct relative speed of rotation between the inner and outer pump rotors independently of driving contact directly between their helical surfaces is formed, in this case, by a substantially simplified version of the gear shown in FIG. 5. The parts corresponding to the shafts 9*a* and 44 and gearwheels 38*a*, 46, 46*a*, 46*b* and 48 will be superfluous and the shafts 45*a* and 45 may be shortened. In FIG. 6, the remaining gearwheels 143, 148, 133 and 147 correspond to, respectively, 43, 48*a*, 33*a* and 47*a* of FIG. 5. The rotor 106 of the motor will drive the outer pump rotor 119 and gearwheel 143 directly and set the gearwheels 148 and 147 with a common shaft, not shown, in mutually synchronous motion. The gearwheel 147 further engages the gearwheel 133 which will then drive the inner rotor 118 in the assumedly exactly correct gear ratio of (Z+1)/Z relative to the outer rotor, that is to say:

$$(z_{143}/z_{148})*(z_{147}/z_{133})=(Z+1)/Z=2$$

in which $z_{143}$, $z_{148}$, $z_{147}$, $z_{133}$ are the tooth numbers of 143, 148, 147 and 133, respectively.

The invention claimed is:

1. A progressive cavity pump comprising:

at least one inner rotor with Z external threads and a helical surface, the inner rotor comprising a helical part; and at least one outer rotor with Z+1 internal threads and a helical surface, wherein the outer rotor has radial bearings at both ends and the inner rotor only has as radial bearing to one side of its helical part, wherein a gear is arranged on to same side of the inner rotor as the radial bearing of the inner rotor, and wherein the gear is configured to maintain a stable ratio between rotational speeds of the inner rotor and the outer rotor equalling a ratio (Z+1)/Z independently of driving contact between the helical surfaces of the inner and outer rotors.

2. The progressive cavity pump in accordance with claim 1, wherein the gear and the radial bearing of the inner rotor are arranged on an inlet side of the pump.

3. The progressive cavity pump in accordance with claim 1, further comprising a dynamic seal having a diameter on an outlet side of the outer rotor that is minimized by the inner rotor being terminated upstream relative to the dynamic seal.

4. The progressive cavity pump in accordance with claim 3, wherein a flow area of the outer rotor is circular under a second seal, and wherein a cavity cross section of the outer rotor is reduced in the flow area such that the cavity cross section of the outer rotor corresponds to a cross-sectional area of the helical part of the inner rotor.

5. The progressive cavity pump in accordance with claim 1 further comprising a mechanical seal on an outlet side of the outer rotor, wherein the mechanical seal has a static part and a dynamic part such that both the static part and the dynamic part are adapted for internal installation in a bore.

6. The progressive cavity pump in accordance with claim 1, further comprising a dynamic seal on an inlet side of the pump, wherein one of the radial bearings of the outer rotor is arranged on the inlet side of the pump, wherein the gear and the radial bearing of the inner rotor are arranged on an outlet side of the pump, wherein the helical part of the inner rotor starts downstream relative to the one of the radial bearings of the outer rotor and the dynamic seal on the inlet side, and wherein a flow area upstream relative to the helical part of the inner rotor and a helical part of the outer rotor is circular with a maximal area relative to a space available within the one of the radial bearings of the outer rotor and the dynamic seal on the inlet side.

7. The progressive cavity pump in accordance with claim 1, wherein the gear is a wheel gear with an internal toothing and a rotary axis parallel with the inner rotor, wherein an external toothing on the inner rotor is engaged with the internal toothing of the wheel gear, and wherein the wheel gear has an external toothing being engaged with an internal toothing of the outer rotor.

8. The progressive cavity pump in accordance with claim 1, wherein a motor is arranged eccentrically relative to the outer rotor, and is configured to drive the inner rotor directly via a coupling.

9. The progressive cavity pump in accordance with claim 1, wherein a motor is arranged concentrically and is configured to drive the inner rotor via an intermediate shaft with two universal joints.

10. The progressive cavity pump in accordance with claim 1, further comprising a motor having a rotor and a stator, wherein the outer rotor is configured to be driven directly by the motor by the rotor of the motor being fixedly connected with and concentrically surrounding the outer rotor of the pump and the stator of the motor being fixed in a housing that houses one of the radial bearings of the outer rotor of the pump.

11. The progressive cavity pump in accordance with claim 1, further comprising;

a motor installed concentrically with an axis of the outer rotor, a first gearwheel on the inner rotor; and a second gearwheel mounted on a drive shaft of the motor and engaged with the first gearwheel on the inner rotor.

12. The progressive cavity pump in accordance with claim 1, further comprising a motor having a rotor and a stator, wherein the rotor of the motor forms a direct extension of a helical cavity of the outer rotor of the pump on a side of the gear, and wherein the rotor of the motor has an internal cavity on the direct extension of the helical cavity of the outer rotor.

13. The progressive cavity pump in accordance with claim 12, wherein the rotor of the motor uses at least part of the radial hearings of the outer rotor and dynamic seals of the outer rotor.

14. The progressive cavity pump in accordance with claim 1, further comprising a motor having a rotor, wherein a fixed connection between the outer rotor and the rotor of the motor contains principally radial openings configured to allow a portion of pumping medium to flow externally past the motor to contribute to cooling of the motor.

15. The progressive cavity pump in accordance with claim 14, wherein dynamic seals are arranged on sides of said radial openings such that the pumping medium is prevented from direct contact with motor windings or bearings.

16. The progressive cavity pump in accordance with claim 1, further comprising a motor having a rotor, and wherein the rotor of the motor is hollow, allowing flow-through by pumping medium.

17. The progressive cavity pump in accordance with claim 1, further comprising:

a motor having a rotary axis;

a driving gearwheel for the outer rotor with external toothing surrounding a cavity of the outer rotor, the outer rotor having a rotary axis;

a driving gearwheel for the inner rotor with external toothing surrounding a flow area;

a driving gearwheel for the motor of the pump concentrically arranged relative to the outer rotor; and at least two planet shafts with rotary axes arranged at a same fixed distance from the rotary axes of the motor and the outer rotor, wherein the gear is a wheel gear, wherein each of the at least two planet shafts comprises a first gearwheel for constant engagement with the gearwheel for the outer rotor and a second gearwheel for constant engagement with the gearwheel for the motor, and wherein at least one of the at least two planet shafts comprises a third gearwheel for constant engagement with the gearwheel of the inner rotor.

18. The progressive cavity pump in accordance with claim 1, further comprising a motor having a rotor, wherein the motor surrounds the outer rotor such that the outer rotor and the rotor of the motor are combined, rotating together, wherein, the outer rotor has an external toothing on an inlet side which is in constant engagement with at least one planet wheel, wherein the planet wheel has two gearwheels on a common shaft, wherein one of the two gearwheels on the common shaft is engaged with a gearwheel of the outer rotor and the other of the two gearwheels on the common shaft is engaged with a gearwheel fixedly and concentrically mounted on the inner rotor.

19. The progressive cavity pump in accordance with claim 18, wherein the two gearwheels on the common shaft, the gearwheel of the outer rotor, and the gearwheel mounted on the inner rotor form a gear ratio (Z+1)/Z between the inner rotor and the outer rotor of the pump.

20. The progressive cavity pump in accordance with claim 1, further comprising a motor having a rotor, wherein the motor surrounds the outer rotor such that the outer rotor and the rotor of the motor are combined, rotating together, wherein, the outer rotor has an external toothing on an inlet side which is in constant engagement with two planet wheels, wherein each of the two planet wheels has two gearwheels on a common shaft, wherein one of the two gearwheels on each of the two common shafts is engaged with a gearwheel of the outer rotor and the other of the two gearwheels on each of the two common shafts is engaged with a gearwheel fixedly and concentrically mounted on the inner rotor.

21. The progressive cavity pump in accordance with claim 20, wherein the two gearwheels on each of the two common shafts, the gearwheel of the outer rotor, and the gearwheel mounted on the inner rotor form a gear ratio (Z+1)/Z between the inner rotor and the outer rotor of the pump.

22. The progressive cavity pump in accordance with claim 1, wherein one of the radial bearings of the outer rotor is close to one side of the outer rotot and another of the radial bearings of the outer rotor is close to another side of the outer rotor.

* * * * *